US007016472B2

(12) United States Patent
Subraya et al.

(10) Patent No.: US 7,016,472 B2
(45) **Date of Patent: *Mar. 21, 2006**

(54) X-RAY TUBE WINDOW COOLING APPARATUS

(75) Inventors: Madhusudhana T. Subraya, New Berlin, WI (US); Carey S. Rogers, Waukesha, WI (US); Manohar G. Kollegal, Bangalore (IN); Doug Snyder, Carmel, IN (US); Krystyna Truszkowska, Niskayuna, NY (US)

(73) Assignee: General Electric Company, Schnectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/683,306

(22) Filed: Oct. 10, 2003

(65) Prior Publication Data

US 2004/0114724 A1 Jun. 17, 2004

Related U.S. Application Data

(63) Continuation-in-part of application No. 10/065,392, filed on Oct. 11, 2002, now Pat. No. 6,714,626.

(51) Int. Cl.
*H01J 35/16* (2006.01)

(52) U.S. Cl. ..... 378/141; 378/140

(58) Field of Classification Search ..... 378/140, 378/141, 130, 127, 119

See application file for complete search history.

(56) References Cited

U.S. PATENT DOCUMENTS

| | | | | |
|---|---|---|---|---|
| 4,976,113 | A * | 12/1990 | Gershuni et al. | 62/314 |
| 6,215,852 | B1 * | 4/2001 | Rogers et al. | 378/142 |
| 6,263,046 | B1 | 7/2001 | Rogers | |
| 6,301,332 | B1 | 10/2001 | Rogers et al. | |
| 6,438,208 | B1 | 8/2002 | Koller | |
| 6,714,626 | B1 * | 3/2004 | Subraya et al. | 378/141 |

* cited by examiner

*Primary Examiner*—David V. Bruce
*Assistant Examiner*—Hoon Song
(74) *Attorney, Agent, or Firm*—Peter J. Vogel

(57) ABSTRACT

An x-ray tube window cooling assembly (11) for an x-ray tube (18) includes an electron collector body (110). The electron collector body (110) is thermally coupled to an x-ray tube window (102). The electron collector body (110) includes a coolant circuit (112) with a coolant inlet (114) and a coolant outlet (122). Multiple thermal exchange devices are coupled to the coolant circuit (112) and reduce temperature of a coolant passing through the exchange devices.

20 Claims, 5 Drawing Sheets

X-RAY TUBE WINDOW COOLING APPARATUS

RELATED APPLICATION

The present application is a Continuation-In-Part (CIP) application of U.S. patent application Ser. No. 10/065,392, filed Oct. 11, 2002, now U.S. Pat. No. 6,714,626 entitled "JET COOLED X-RAY TUBE WINDOW", which is incorporated by reference herein.

TECHNICAL FIELD

The present invention relates generally to thermal energy management systems within electron beam generating devices. More particularly, the present invention relates to an assembly for cooling an x-ray tube window.

BACKGROUND OF THE INVENTION

There is a continuous effort to increase scanning capabilities of x-ray imaging systems. This is especially true in computed tomography (CT) imaging systems. Customers desire the ability to perform longer scans at increased power levels. The increase in scan times at higher power levels allows physicians to gather CT images and constructions in a matter of seconds rather than in a matter of several minutes as with previous CT imaging systems. Although the increase in imaging speed provides improved imaging capability, the increase causes new constraints and requirements for the functionality of the CT imaging systems.

A CT imaging system typically includes a gantry that rotates at various speeds in order to create a 360° image. The gantry contains an x-ray tube, which composes a large portion of the rotating gantry mass. The CT tube generates x-rays across a vacuum gap between a cathode and an anode. In order to generate the x-rays, a large voltage potential is created across the vacuum gap, which allows electrons to be emitted, in the form of an electron beam. The electron beam is emitted from the cathode to a target on the anode. In releasing of the electrons, a filament contained within the cathode is heated to incandescence by passing an electric current therein. The electrons are accelerated by the high voltage potential and impinge on the target, where they are abruptly slowed down to emit x-rays. The high voltage potential produces a large amount of heat within the x-ray tube, especially within the anode.

The vacuum vessel is typically enclosed in a casing filled with circulating cooling fluid, such as dielectric oil. The cooling fluid often performs two duties: cooling the vacuum vessel, and providing high voltage insulation between the anode and the cathode. High temperatures at an interface between the vacuum vessel and a transmissive window in the casing cause the cooling fluid to boil, which may degrade the performance of the cooling fluid. Bubbles may form within the fluid and cause high voltage arcing across the fluid. The arcing degrades the insulating ability of the fluid. The bubbles can cause image artifacts that can result in low quality images.

Typically, a small portion of energy within the electron beam is converted into x-rays; the remaining electron beam energy is converted into thermal energy within the anode. Due to the inherent poor efficiency of x-ray production and the desire for increased x-ray flux, heat load is increased that must be dissipated. The thermal energy is radiated to other components within a vacuum vessel of the x-ray tube. Some of the thermal energy is removed from the vacuum vessel via the cooling fluid. Approximately 40% of the electrons within the electron beam are back-scattered from the anode and impinge on other components within the vacuum vessel, causing additional heating of the x-ray tube. As a result, the x-ray tube components are subjected to high thermal stresses that decrease component life and reliability of the x-ray tube.

Prior art cooling methods have primarily relied on quickly dissipating thermal energy by circulating coolant within structures contained in the vacuum vessel. The coolant fluid is often a special fluid for use within the vacuum vessel, as opposed to the cooling fluid that circulates about the external surface of the vacuum vessel.

As power of the x-ray tubes continues to increase, heat transfer rate to the coolant can exceed heat flux absorbing capabilities of the coolant. Other methods have been proposed to electromagnetically deflect the back-scattered electrons so that they do not impinge on the x-ray window. These approaches, however, do not provide for significant levels of energy storage a dissipation.

A thermal energy storage device or electron collector, coupled to an x-ray window, has been used to collect back-scattered electrons between the cathode and the anode. The electron collector is typically implemented in monopolar x-ray tubes. The x-ray window is typically formed of a material having a low atomic number, such as beryllium. A significant amount of heat is generated from the impact of the back-scattered electrons on the electron collector and X-ray window, due to retention of a significant amount of kinetic energy in the back-scattered electrons.

In using the electron collector, the collector and window need to be properly cooled to prevent high temperature and thermal stresses, which can damage the window and joints between the window and collector. High temperature surfaces of the window and collector can induce boiling of the coolant. Bubbles generated from the boiling coolant can obscure the window and thereby compromise image quality. Extensive boiling of the coolant results in chemical breakdown of the coolant and the formation of sludge on the window, which also results in poor image quality.

Thus, there exists a need for an improved apparatus and method of cooling an x-ray tube window that allows for increased scanning speed and power, is relatively easy to manufacture, and minimizes blurring and artifacts in a reconstructed image.

SUMMARY OF THE INVENTION

The present invention provides an x-ray tube window cooling assembly for an x-ray tube that includes an electron collector body. The electron collector body is thermally coupled to an x-ray tube window. The electron collector body includes a coolant circuit with a coolant inlet and a coolant outlet. Multiple thermal exchange devices are coupled to the coolant circuit and reduce temperature of a coolant passing through the exchange devices.

The embodiments of the present invention provide several advantages. One such advantage that is provided by multiple embodiments of the present invention is the provision of a cooling mechanism located within the electron collector and formed of a porous material, which effectively removes thermal energy from the coolant. The porous material absorbs a substantial amount of thermal energy generated from back-scattered electrons.

Another advantage that is provided by multiple embodiments of the present invention is the provision of an apparatus for directing coolant at an x-ray tube window. Directing coolant at the x-ray tube window efficiently cools the window, minimizes deposit formation on the window, and aids in washing away deposits as soon as they are formed. As a result, directing coolant at the x-ray tube window minimizes blurring and artifacts in a reconstructed image.

The present invention itself, together with attendant advantages, will be best understood by reference to the following detailed description, taken in conjunction with the accompanying figures.

BRIEF DESCRIPTION OF THE DRAWINGS

For a more complete understanding of this invention reference should now be had to the embodiments illustrated in greater detail in the accompanying figures and described below by way of examples of the invention wherein.

DETAILED DESCRIPTION

While the present invention is described with respect to an assembly for cooling an x-ray tube window within a computed tomography (CT) imaging system, the following apparatus and method is capable of being adapted for various purposes and is not limited to the following applications: MRI systems, CT systems, radiotherapy systems, flouroscopy systems, X-ray imaging systems, ultra sound systems, vascular imaging systems, nuclear imaging systems, magnetic resonance spectroscopy systems, and other applications known in the art.

In the following description, various operating parameters and components are described for one constructed embodiment. These specific parameters and components are included as examples and are not meant to be limiting.

Also, in the following description the term "impinge" refers to an object colliding directly with another object. For example, as known in the art, an electron beam impinges upon a target of an anode within an x-ray tube. The electron beam is directed at the target such that electrons within the beam collide with the target. Similarly, a coolant may be directed at a surface as to collide with the surface. The coolant in being directed at a surface may be reflected from another surface. The term "impinge" does not refer to an object simply coming into contact with another object, such as coolant flowing over a surface of an object.

Additionally, the term "thermal exchange device" may refer to a porous body, a porous element, a channel, a pocket, a fin pocket, a cooling fin or other thermal exchange device known in the art. More than one thermal exchange device may exist in an electron collector body. For example, a coolant channel may have a porous body contained therein. Coolant may pass through the porous body when passing through the coolant channel. The coolant channel and the porous body are both considered thermal exchange devices.

Figure 1:
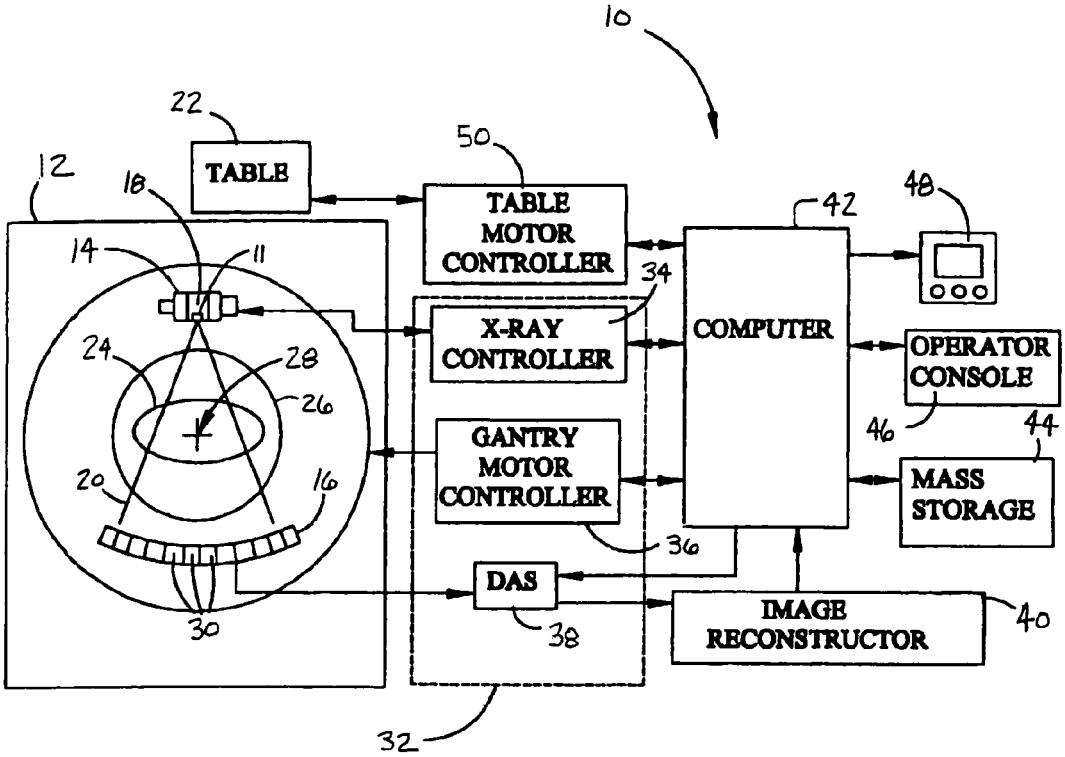
FIG. 1 is a schematic block diagrammatic view of a multi-slice CT imaging system utilizing an x-ray tube window cooling assembly in accordance with an embodiment of the present invention.

Referring now to FIG. 1, a schematic block diagrammatic view of a multi-slice CT imaging system 10 utilizing an x-ray tube window cooling assembly 11 in accordance with an embodiment of the present invention is shown. The imaging system 10 includes a gantry 12 that has an x-ray tube assembly 14 and a detector array 16. The x-ray tube assembly 14 has an x-ray generating device or x-ray tube 18. The tube 18 projects a beam of x-rays 20 towards the detector array 16. The tube 18 and the detector array 16 rotate about an operably translatable table 22. The table 22 is translated along a z-axis between the assembly 14 and the detector array 16 to perform a helical scan. The beam 20 after passing through a medical patient 24, within a patient bore 26, is detected at the detector array 16. The detector array 16 upon receiving the beam 20 generates projection data that is used to create a CT image.

The tube 18 and the detector array 16 rotate about a center axis 28. The beam 20 is received by multiple detector elements 30. Each detector element 30 generates an electrical signal corresponding to the intensity of the impinging x-ray beam 20. As the beam 20 passes through the patient 24 the beam 20 is attenuated. Rotation of the gantry 12 and the operation of tube 18 are governed by a control mechanism 32. The control mechanism 32 includes an x-ray controller 34 that provides power and timing signals to the tube 18 and a gantry motor controller 36 that controls the rotational speed and position of the gantry 12. A data acquisition system (DAS) 38 samples analog data from the detector elements 30 and converts the analog data to digital signals for subsequent processing. An image reconstructor 40 receives sampled and digitized x-ray data from the DAS 38 and performs high-speed image reconstruction. A main controller or computer 42 stores the CT image in a mass storage device 44.

The computer 42 also receives commands and scanning parameters from an operator via an operator console 46. A display 48 allows the operator to observe the reconstructed image and other data from the computer 42. The operator supplied commands and parameters are used by the computer 42 in operation of the DAS 38, the x-ray controller 34, and the gantry motor controller 36. In addition, the computer 42 operates a table motor controller 50, which translates the table 22 to position patient 24 in the gantry 12.

The x-ray controller 34, the gantry motor controller 36, the image reconstructor 40, the computer 42, and the table motor controller 50 may be microprocessor-based such as a computer having a central processing unit, memory (RAM and/or ROM), and associated input and output buses. The x-ray controller 34, the gantry motor controller 36, the image reconstructor 40, the computer 42, and the table motor controller 50 may be a portion of a central control unit or may each be stand-alone components as shown.

Figure 2:
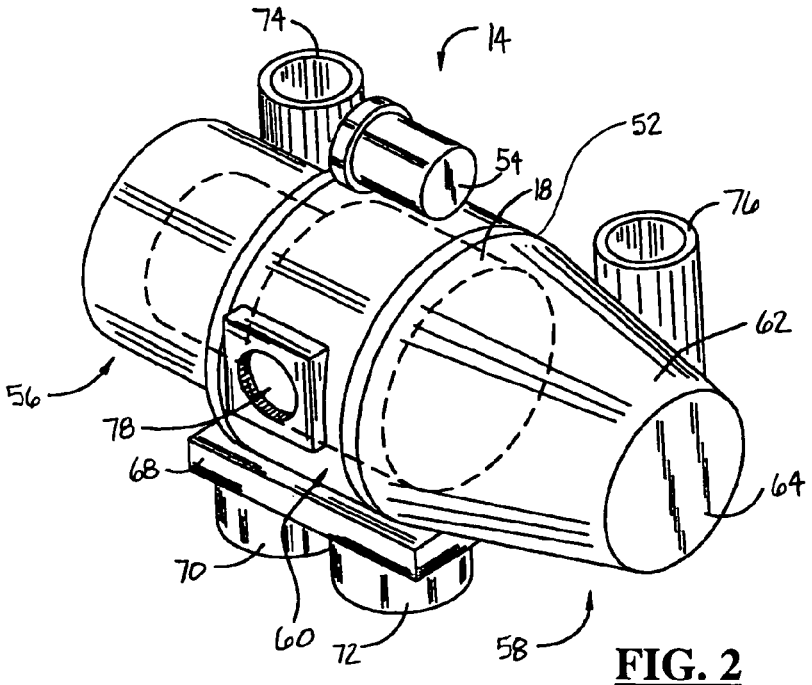
FIG. 2 is a perspective view of a x-ray tube assembly incorporating the x-ray tube window cooling assembly in accordance with an embodiment of the present invention.

Referring now to FIG. 2, a perspective view of the x-ray tube assembly 14 incorporating the cooling assembly 11 in accordance with an embodiment of the present invention is shown. The tube assembly 14 includes the x-ray tube 18, a housing unit 52 having a coolant pump 54, an anode end 56, a cathode end 58, and a center section 60. The center section 60 is positioned between the anode end 56 and the cathode end 58. The x-ray tube 18 is enclosed in a fluid chamber 62 that is within a lead-lined casing 64. The chamber 62 is typically filled with fluid, such as dielectric oil, but other fluids including water or air may be utilized. The fluid circulates through housing 52 to cool the x-ray tube 18 and may insulate the casing 64 from the high electrical charges within the x-ray tube 18. A radiator 68 is positioned to one side of the center section 60 and cools the cooling fluid 66. The radiator 68 may have fans 70 and 72 operatively connected to the radiator 68, which provide airflow over the radiator 68. The pump 54 is provided to circulate the fluid 66 through the housing 52, through the radiator 68, and through the cooling assembly 11. Electrical connections, for communication with the x-ray tube 18, are provided through an anode receptacle 74 and a cathode receptacle 76. A casing window 78 is provided for x-ray emission from the casing 64.

Figure 3:
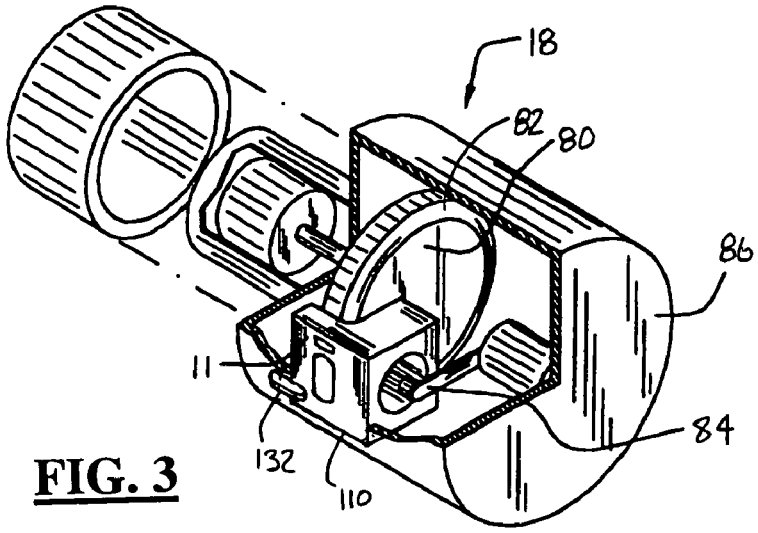
FIG. 3 is a sectional perspective view of an x-ray tube incorporating the x-ray tube window cooling assembly in accordance with an embodiment of the present invention.
Figure 4:
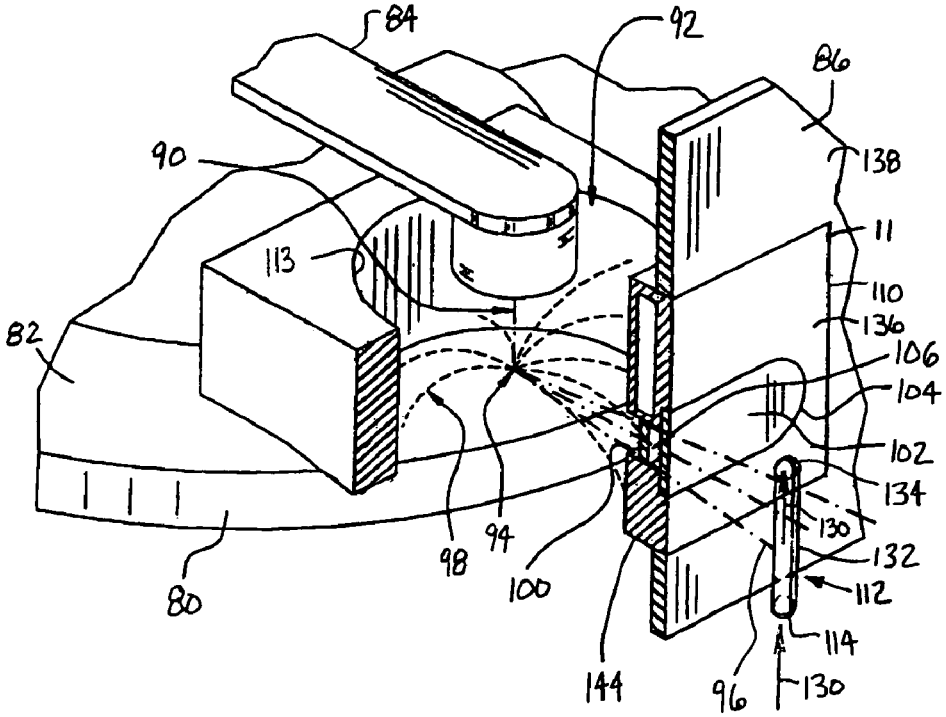
FIG. 4 is a close-up sectional perspective view of the x-ray tube incorporating the x-ray tube window cooling assembly in accordance with an embodiment of the present invention.

Referring now to FIGS. 3 and 4, sectional perspective views of the x-ray tube 18 incorporating the cooling assembly 11 in accordance with an embodiment of the present invention is shown. The x-ray tube 18 includes a rotating anode 80, having a target 82, and a cathode assembly 84. The cathode assembly 84 is disposed in a vacuum within vessel 86. The cooling assembly 11 is interposed between the anode 80 and the cathode 84.

In operation, an electron beam 90 is directed through a central cavity 92 and accelerated toward the anode 80. The electron beam 90 impinges upon a focal spot 94 on the target 82 and produces high frequency electromagnetic waves or x-rays 96 and residual energy. The residual energy is absorbed by the components within the x-ray tube 18. The x-rays 96 are directed through the vacuum toward an aperture 100 in the cooling assembly 11. The aperture 100 collimates the x-rays 96, thereby reducing the radiation dosage received by the patient 24.

The residual energy includes radiant thermal energy from anode 80 and kinetic energy of back-scattered electrons 98 that deflect off the anode 80. The kinetic energy is converted into thermal energy upon impact with the components in the vessel 86. A portion of the kinetic energy is absorbed by the cooling assembly 11 and transferred to the coolant circulating therein.

Disposed within the aperture 100 is an x-ray tube window 102, formed of a material that efficiently allows passage of the x-rays 96. The window 102 is hermetically sealed to the cool assembly 11 at a joint 104. The window 102 may be sealed through vacuum brazing or welding processes known in the art. The seal 104 serves to maintain the vacuum within the vessel 86. A filter 106 is mounted within the aperture 100 and is disposed between the anode 80 and the window 102. Similar to the window 102, the filter 106 allows the passage of the diagnostic x-rays 96.

Figure 5:
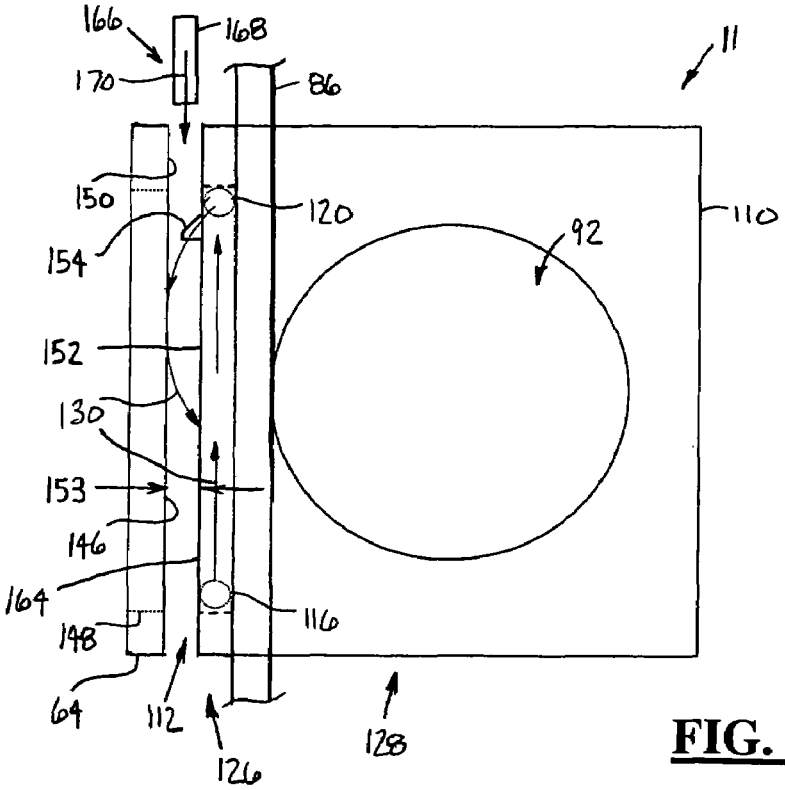
FIG. 5 is a top view of the x-ray tube window cooling assembly in accordance with an embodiment of the present invention.
Figure 6:
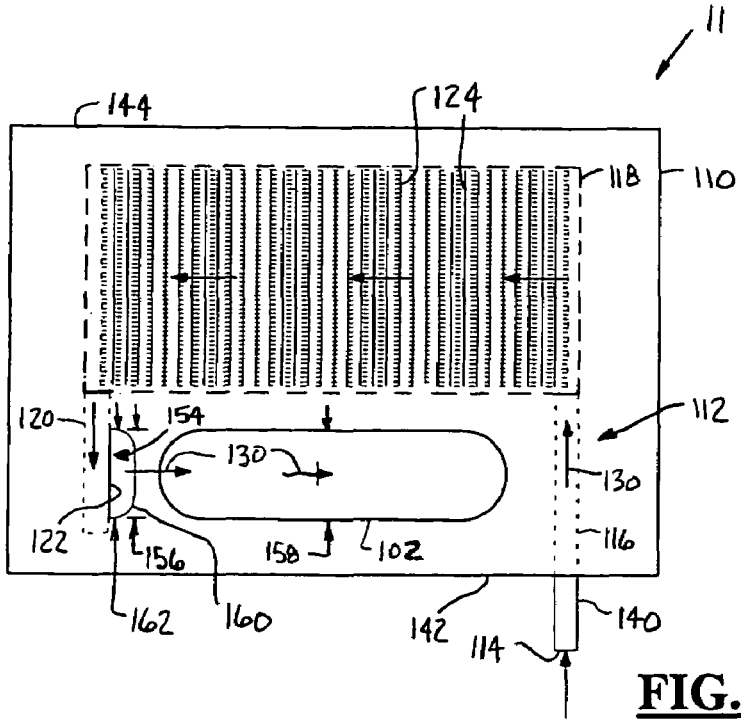
FIG. 6 is a front view of the x-ray tube window cooling assembly in accordance with an embodiment of the present invention.

Referring now to FIG. 4 and to FIGS. 5 and 6, where a front view and a side view of the cooling assembly 11 in accordance with an embodiment of the present invention are shown. The cooling assembly 11 includes an electron collector body 110 with a first coolant circuit 112. The back-scattered electrons 98 impinge upon an inner side 113 of the collector body 110. The inner side 113 surrounds the beam 90 such that a majority of the kinetic energy in the back-scattered electrons 98 is absorbed into the collector body 110. The first coolant circuit 112 includes a coolant inlet 114, a first channel 116, a fin pocket 118, a second channel 120, and a coolant outlet 122. Coolant is received through the inlet 114, through the first channel 116, is cooled by the multiple cooling fins 124 within the fin pocket 118, passes through the second channel 120, and is then directed at the window 102 by the outlet 122.

The collector 110 has a coolant side 126 and a vacuum side 128. The coolant side 126 includes the inlet 114 and the outlet 122. In one embodiment of the present invention, as illustrated by FIGS. 3 and 4, the coolant enters the first channel 116, as is represented by arrows 130. The coolant 130 enters the first channel 116 via a first external tube 132 that is coupled over an opening 134, in a collector exterior surface 136, of the collector 110. In the embodiment of FIGS. 3 and 4, the vessel exterior surface 138 is flush with the collector surface 136. In another embodiment of the present invention, as illustrated by FIGS. 4 and 5, when the collector 110 protrudes from the vessel 86 a second external tube 140 may be attached on a lower side 142 of the collector 110.

The fin pocket 118 is located within a single wall 144 of the collector 110 above the window 102. By having the fin pocket 118 only on the coolant side 126, risk of a vacuum leak is minimized since the fins 124 are not brazed to a side of the collector 110 that is on the vacuum side 128, as in prior art thermal energy storage devices. When fins are brazed into a side of a collector, seams are created, which can develop leaks over time. Incorporation of the fins 124 in a single wall 144 of the collector 110, eliminates the seams within the collector 110, on the vacuum side 128, resulting in less potential for vacuum leaks. Although the fin pocket 118 may be on multiple sides of the collector 110 and may be in multiple locations, by having the fin pocket located as stated, manufacturing simplicity is provided and efficient thermal energy transfer is maintained. Although multiple cooling fins 124 are shown as lanced offset cooling fins, other style cooling fins or high efficiency extended cooling surfaces known in the art may be used.

The outlet 122 directs coolant at a reflection surface 146 on the x-ray tube 118. The reflection surface 146 may be a portion of a transmissive device 148 of the casing 64, as shown, may be an internal casing wall surface 150, or may be some other deflection surface known in the art. The reflection surface 146 is located opposite that of an x-ray tube window surface 152, with a gap 153 there between. The coolant 130 passes through the fin pocket 118 and is then directed from the outlet 122 to reflect off the reflection surface 146 to impinge upon and cool the window 102. The gap 153 may be of various widths and may be adjusted such that the coolant 130 impinges appropriately on the window 102.

The outlet 122 has an opening 154 with a cross-sectional area that is smaller relative to the cross-sectional area of the fin pocket 118. The opening 154 is perpendicular to the direction of the coolant flow such that as the coolant 130 is passed from the fin pocket 118 through the outlet 122 the velocity of the coolant 130 increases. By increasing the velocity of the coolant 130, the outlet 122 in conjunction with the fin pocket 118 performs as a coolant jet, which further aids in the cooling of the window 102. Also, the outlet 122 has an opening width 156 that is approximately equal to a width 158 of the window 102. The coolant 130 impinges across the width 158 and provides uniform cooling of the window 102.

A guide 160 may be incorporated to aid in flow direction of the coolant 130. The guide 160 may also have similar width to that of the opening width 156 and width 158, as shown by designated width 162. The guide 160 may be in various forms, sizes, and styles. The guide 160 may protrude from the collector 110, as shown, or may be incorporated within the collector 110 to be flush with the collector exterior surface 164.

The transmissive device 148 is in the form of a transmissive window that allows the x-rays 96 to pass through the casing 64. The transmissive device 148 may be formed of aluminum or other material known in the art.

A second coolant circuit 166 may be incorporated within the cooling assembly 11 and include an auxiliary coolant jet 168 to direct additional coolant 170 to flow across the window surface 152, as best seen in FIG. 5. The auxiliary jet 168 directs the coolant 170 in the same direction as the flow of the coolant 130 from the outlet 122 to increase the coolant flow to and cooling of the window 102. The auxiliary jet 168 may be in various locations and have various orientations.

The cooling circuits 112 and 166 may receive the coolant 130 from the pump 54, via a separate pump, or from some other coolant source known in the art.

Figure 7:
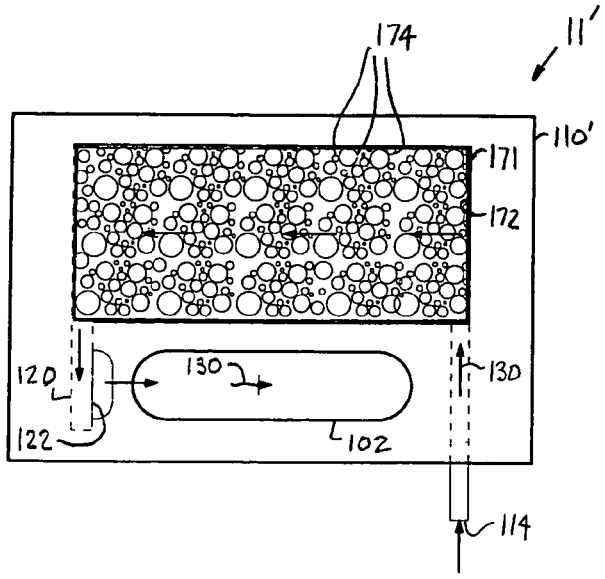
FIG. 7 is a front view of an x-ray tube window cooling assembly incorporating a porous body external to a vacuum side of an x-ray tube in accordance with another embodiment of the present invention.

Referring now to FIG. 7, a front view of an x-ray tube window cooling assembly 11' incorporating a porous body 171 external to the vacuum side 128 of the x-ray tube 118 in accordance with another embodiment of the present invention is shown. The porous body 171 is a thermal exchange device, such as a heat exchanger, and resides within a pocket 172. The porous body 171 absorbs thermal energy from the collector 110 and transfers it to the coolant 130. The porous body 171 is formed of a porous material, such as a porous metal, a porous graphite, some other porous material known in the art having similar properties, or some combination thereof. The porous material is represented by the circles 174. The porous body 171 has a large surface area and a high heat transfer coefficient, thereby allowing it to absorb a substantial amount of thermal energy. The porous body 171 may be formed as an integral part of the collector 110' or be separate from the collector 110' and reside within the pocket 172, as shown.

The transmissive device 148 is in the form of a transmissive window that allows the x-rays 96 to pass through the casing 64. The transmissive device 148 may be formed of aluminum or other material known in the art.

A second coolant circuit 166 may be incorporated within the cooling assembly 11 and include an auxiliary coolant jet 168 to direct additional coolant 170 to flow across the window surface 152, as best seen in FIG. 5. The auxiliary jet 168 directs the coolant 170 in the same direction as the flow of the coolant 130 from the outlet 122 to increase the coolant flow to and cooling of the window 102. The auxiliary jet 168 may be in various locations and have various orientations.

The cooling circuits 112 and 166 may receive the coolant 130 from the pump 54, via a separate pump, or from some other coolant source known in the art.

Referring now to FIG. 7, a front view of an x-ray tube window cooling assembly 11' incorporating a porous body 171 external to the vacuum side 128 of the x-ray tube 118 in accordance with another embodiment of the present invention is shown. The porous body 171 is a thermal exchange device, such as a heat exchanger, and resides within a pocket 172. The porous body 171 absorbs thermal energy from the collector 110 and transfers it to the coolant 130. The porous body 171 is formed of a porous material, such as a porous metal, a porous graphite, some other porous material known in the art having similar properties, or some combination thereof. The porous material is represented by the circles 174. The porous body 171 has a large surface area and a high heat transfer coefficient, thereby allowing it to absorb a substantial amount of thermal energy. The porous body 171 may be formed as an integral part of the collector 110' or be separate from the collector 110' and reside within the pocket 172, as shown.

Figure 8:
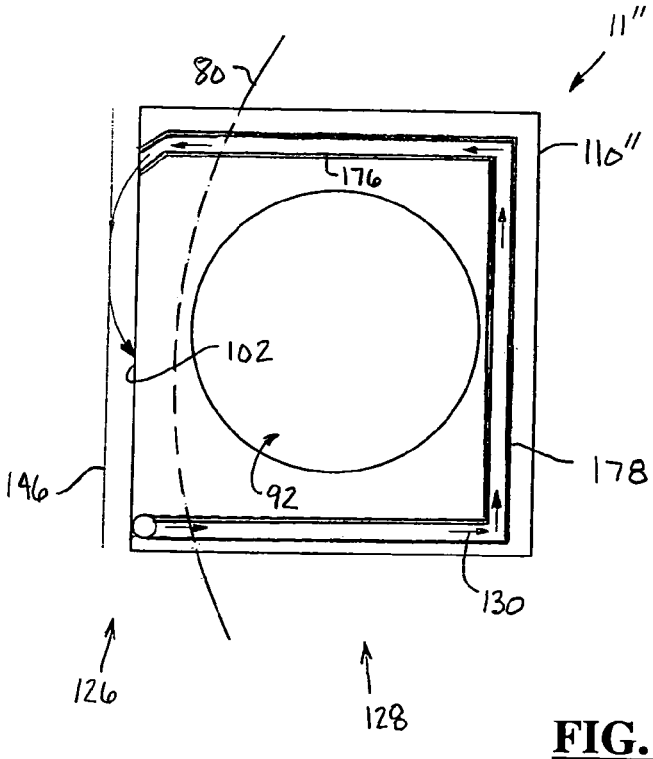
FIG. 8 is a top view of an x-ray tube window cooling assembly incorporating a porous body on a vacuum side of an x-ray tube in accordance with another embodiment of the present invention.

Referring now to FIG. 8, a top view of an x-ray tube window cooling assembly 11" incorporating a porous body 176 on a vacuum side 128 of the x-ray tube 18 in accordance with another embodiment of the present invention is shown. The porous body 176 resides within a coolant channel 178 of the electron collector 110". The porous body 176 may be formed integrally with the collector body 110" or may reside within the channel 178, as shown. As with the porous body 171, the porous body 176 is formed of one or more porous materials, such as those stated above.

The porous bodies 171 and 176 of FIGS. 7 and 8 may be of various size and shape and may be located in various locations in the collector bodies 110' and 110". The collector bodies 110' and 110", themselves, may also be formed of one or more porous materials.

Figure 9:
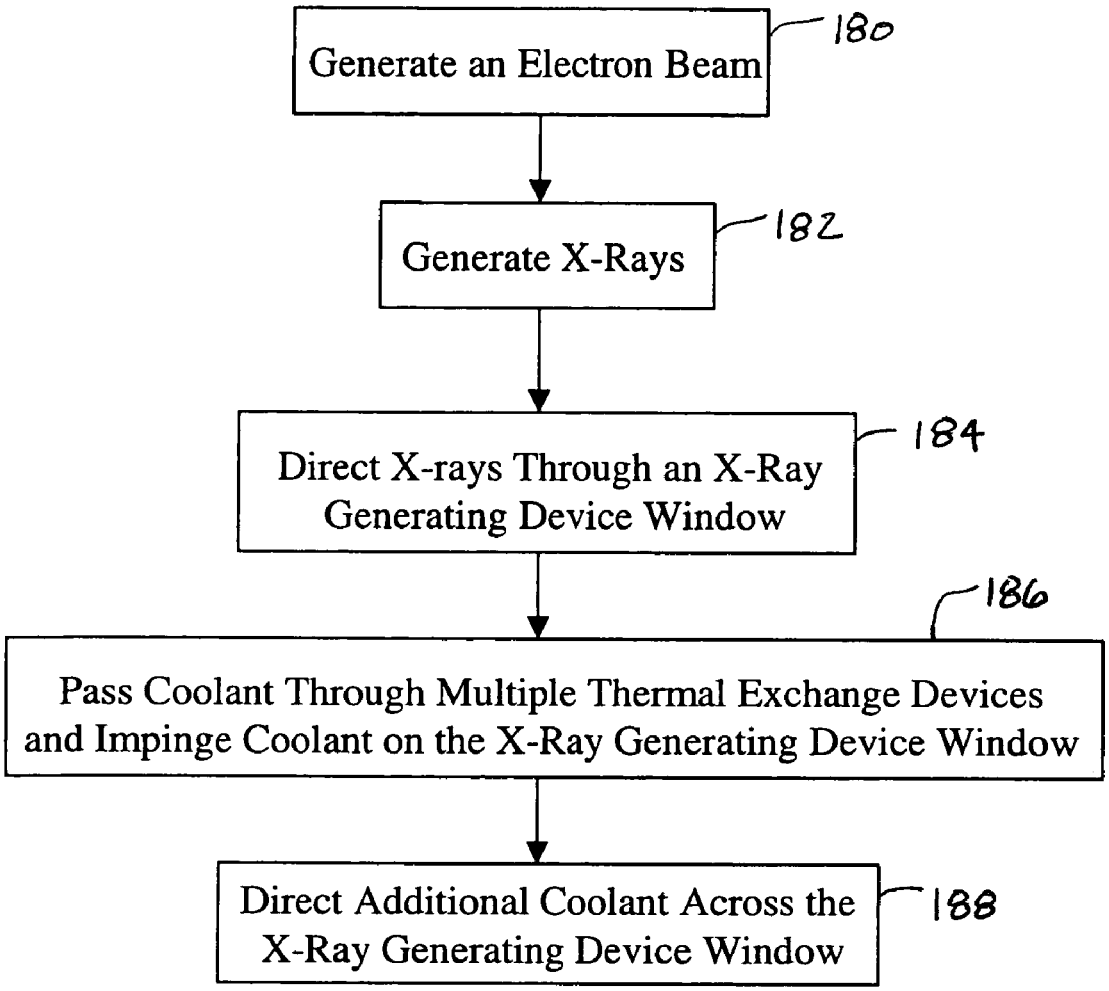
FIG. 9 is a logic flow diagram illustrating a method of operating an x-ray generating device x-ray tube window cooling assembly in accordance with an embodiment of the present invention.

Referring now to FIG. 9, a logic flow diagram illustrating a method of operating the x-ray tube 18 in accordance with an embodiment of the present invention is shown.

In step 180, the electron beam 90 is generated as stated above.

In step 182, the electron beam 90 is directed to impinge upon the target 82 to generate the x-rays 96.

In step 184, the x-rays 96 are directed through the window 102, which increases temperature of the window 102. The back-scattered electrons 98 also impinge upon the window 102 and further increase temperature of the window 102.

In step 186, the coolant 130 is passed through multiple thermal exchange devices, such as the fin pocket 118, the porous body 171, or the porous body 176, and is directed at the reflection surface 146, as to impinge on and cool the window 102.

In step 188, the additional coolant 170 may be directed across the window 102, via the second cooling circuit 166.

The above-described steps are meant to be an illustrative example; the steps may be performed synchronously or in a different order depending upon the application.

The present invention provides an x-ray generating device window cooling system having multiple thermal exchange devices and thus improved cooling. An embodiment of the present invention provides an electron collector having a body formed of porous material, which further provides increased cooling. Coolant is directed at and across an x-ray tube window preventing generation of deposits and decreasing dwell time of oil on the window, thus preventing oil sludge build-up. The window is efficiently cooled and deposits that exist are separated from the window and washed away, thus minimizing blurring and artifacts in a reconstructed image. Elimination of cooling pockets on the vacuum side of a thermal energy storage device reduces opportunity for leaks and particle contamination.

The above-described apparatus and method, to one skilled in the art, is capable of being adapted for various applications and systems known in the art. The above-described invention can also be varied without deviating from the true scope of the invention.

What is claimed is:

1. An x-ray tube window cooling assembly for an x-ray tube comprising:

an electron collector body thermally coupled to an x-ray tube window and at least partially containing;

a coolant circuit with a coolant inlet and a coolant outlet; and a plurality of thermal exchange devices comprising at least one porous element, said plurality of thermal exchange devices non-integrally formed as part of said electron body and configured and coupled to said coolant circuit to reduce temperature of a coolant and allow for flow of the coolant circulating through said plurality of thermal exchange devices.

2. An assembly as in claim 1 wherein said electron collector body is formed at least partially of a porous material.

3. An assembly as in claim 1 wherein each of said plurality of thermal exchange devices are selected from at least one of a porous body, a channel, a pocket, a fin pocket, and a cooling fin.

4. An assembly as in claim 1 wherein said plurality of thermal exchange devices comprise a porous body formed of a material selected from at least one of a metal and a graphite.

5. An assembly as in claim 1 wherein said plurality of thermal exchange devices comprise:

a first thermal exchange device; and a second thermal exchange device coupled within said first thermal exchange device.

6. An assembly as in claim 5 wherein said first thermal exchange device is a channel and said second thermal exchange device is a porous body.

7. An assembly as in claim 1 wherein at least a portion of said plurality of thermal exchange devices resides within a vacuum side of the x-ray tube.

8. An assembly as in claim 1 wherein at least a portion of said plurality of thermal exchange devices resides external to a vacuum side of the x-ray tube.

9. An assembly as in claim 1 wherein said electron collector body comprises an inner wall that receives back-scattered electrons.

10. An assembly as in claim 1 wherein said electron collector body surrounds at least a portion of an electron beam.

11. An assembly as in claim 1 wherein at least a portion of said electron collector body resides on a vacuum side of the x-ray tube.

12. An assembly as in claim 1 wherein at least a portion of said electron collector body resides external to a vacuum side of the x-ray tube.

13. An x-ray tube window cooling assembly for an x-ray tube comprising:

an electron collector body thermally coupled to an x-ray tube window and at least partially containing;

a coolant circuit with a coolant inlet and a coolant outlet; and a plurality of thermal exchange devices non-integrally formed as part of said electron body and coupled to said coolant circuit and reducing a temperature of a coolant passing through said plurality of thermal exchange devices, said plurality of thermal exchange devices comprising a pocket and a porous body.

14. An x-ray tube window cooling assembly for an x-ray tube comprising:

an electron collector body thermally coupled to an x-ray tube window and at least partially containing;

a coolant circuit with a coolant inlet and a coolant outlet; and a plurality of thermal exchange devices non-integrally formed as part of said electron body and coupled to said coolant circuit and reducing temperature of a coolant passing through said plurality of thermal exchange devices;

wherein said coolant outlet directs said coolant at an x-ray tube window surface to impinge upon and cool said x-ray tube window.

15. An x-ray tube comprising:

a housing unit;

a cathode coupled within said housing unit and generating an electron beam;

an anode coupled within said housing unit and receiving said electron beam, said anode generating and directing x-rays through an x-ray tube window; and an x-ray tube window cooling assembly comprising an electron collector body thermally coupled to said x-ray tube window and at least partially containing;

a coolant circuit with a coolant inlet and a coolant outlet; and a plurality of thermal exchange devices non-integrally formed as part of said electron body and coupled to said coolant circuit and reducing temperature of a coolant passing through said plurality of thermal exchange devices;

wherein said coolant outlet directs said coolant at an x-ray tube window surface to impinge upon and cool said x-ray tube window.

16. An x-ray tube as in claim 15 wherein said coolant outlet directs coolant at a reflection surface on the x-ray tube, opposite that of an x-ray tube window surface, to reflect said coolant off said reflection surface and impinge upon and cool said x-ray tube window.

17. An x-ray tube as in claim 15 wherein said x-ray tube window cooling assembly is interposed between said cathode and said anode.

18. An x-ray tube as in claim 15 wherein said at least one thermal exchange device comprises a porous body.

19. An x-ray tube as in claim 15 wherein at least a portion of said x-ray tube window assembly is formed of a porous material.

20. A method of operating an x-ray generating device comprising:

generating an electron beam;

directing said electron beam to impinge upon an anode target and generate x-rays;

directing said x-rays through an x-ray tube window;

directing coolant at a reflection surface on the x-ray tube, opposite that of an x-ray tube window surface, to impinge upon and cool the x-ray tube window, via a cooling circuit; and reducing temperature of said coolant via passage of said coolant through a plurality of thermal exchange devices.

* * * * *